US005575483A

United States Patent [19]

Dineen et al.

[11] Patent Number: 5,575,483

[45] Date of Patent: Nov. 19, 1996

[54] GOLF TOSS GAME

[76] Inventors: Robert T. Dineen; Susan M. Michels, both of 770 Meadowbrook Ln., Fond du Lac, Wis. 54935

[21] Appl. No.: 533,687

[22] Filed: Sep. 26, 1995

[51] Int. Cl.[6] ..... A63B 67/00

[52] U.S. Cl. ..... 273/411; 273/400; 273/402; 273/415; 473/170

[58] Field of Search ..... 293/400, 415, 293/401, 402, 411, 176 R, 176 A, 176 AA, 176 AB, 176 B, 176 D, 176 E; 473/150, 165, 169, 170

[56] References Cited

U.S. PATENT DOCUMENTS

| | | | |
|---|---|---|---|
| 2,811,358 | 10/1957 | Ruth | 273/348 |
| 3,027,163 | 3/1962 | Saatzer | 273/176 B X |
| 3,084,941 | 4/1963 | Anthony | 273/176 E |
| 3,348,846 | 10/1967 | Atchison | 273/176 E |
| 3,467,388 | 9/1969 | Weiler | 273/176 A |
| 3,628,793 | 12/1971 | Mudloff | 273/402 |
| 3,871,650 | 3/1975 | Casey | 273/87 R |
| 4,095,793 | 6/1978 | Ray | 273/87 R |
| 5,056,795 | 10/1991 | Buhrow | 273/400 |
| 5,067,730 | 11/1991 | Wanalista | 273/400 |
| 5,112,054 | 5/1992 | Oswald | 273/176 A |
| 5,123,656 | 6/1992 | Green | 273/400 |
| 5,303,931 | 4/1994 | Brown | 273/348 |
| 5,324,042 | 6/1994 | Demas | 273/346 |

*Primary Examiner*—William H. Grieb
*Attorney, Agent, or Firm*—Robert C. Curfiss; Nancy A. Talavera; Butler & Binion, L.L.P.

[57] ABSTRACT

A transportable and inexpensive golf toss game includes colored tossing bags, golf hole cups, flag sticks, markers and a scoring sheet. The game is played by tossing a small bag at receptacles simulating golf holes on a playing course planned and set up by the players in a yard, park or outdoor area to resemble a golf course. The course can be conveniently set up at almost any location and may include obstacles such as trees, shrubs or water. The golf toss game is challenging yet easy to learn and fun to play.

24 Claims, 2 Drawing Sheets

GOLF TOSS GAME

BACKGROUND OF INVENTION

1. Field of Invention

The subject invention is generally related to recreational games and is specifically directed to a golf toss game in which players toss bags at receptacles simulating golf holes arranged and set up on a playing course resembling a golf course.

2. Description of the Prior Art

Tossing games are well known and have been popular for many years. Basically, the games consist of a player tossing an item, such as a bean bag, toward a fixed target and scoring points if the bag hits or lands near the target. While such games are simple, their popularity can be attributed to the fact that they are easily transportable, can be played at almost any location by one or more players and no special or expensive equipment is required. However, due to their simplicity, some tossing games can be quickly mastered and may become boring and unchallenging for the players.

In order to make the game more challenging and enjoyable for the players, there have been many variations of tossing games. One variation of the game is to set up a tic-tac-toe grid on the ground and then have two players stand a certain distance from the grid and take turns tossing their bags onto the grid. The first player to make tic-tac-toe is the winner. Examples of other variations of tossing games are disclosed in U.S. Pat. No. 3,628,793 issued to R. M. Mudloff and U.S. Pat. No. 5,056,795 issued to G. L. Buhrow, U.S. Pat. No. 5,123,656 issued to J. E. Green and U.S. Pat. No. 5,324,042 issued to C. Demas.

All of the prior art tossing games are similar in that the bag is tossed toward a single target and points are determined after a single toss. For example, U.S. Pat. No. 3,628,793 shows a sandbag game in which the target can be transformed into a boxlike carrying and transporting case. The case is separable into a pair of wedge-shaped hollow cases with a receiving and sinking hole and function as a target. As commonly employed when tossing horseshoes or quoits, the targets are set up a certain amount of feet apart and the sandbags are tossed back and forth.

Another typical tossing game is shown in U.S. Pat. No. 5,056,795. The game is designed for both indoor and outdoor use and includes a tossing bag similar to a bean bag, for indoor use, and a hard puck-like plastic disk, for outdoor use. The game also includes a post with a pouch on it, similar to a basketball goal, for receiving the tossed bag or puck and a rope extending from the post to determine scoring of missiles which land a certain distance from the post. To play the game, the players launch their missiles at the target and the first player or team to reach a predetermined point level is the winner.

While there are many tossing games, none of the prior art games disclose a tossing game in which a bag is tossed at several targets set up on a playing course which may include obstacles such as trees, shrubs or water and where each target is set up a different distance from designated starting points, similar to a golf course. Further, none of the prior art games show a game in which the player continues to toss their bag toward the target, beginning each time from the place where the bag landed on the previous toss, until the bag reaches the target.

Therefore, there is a need for an inexpensive and transportable tossing game in which players toss their bags at targets, simulating golf holes, set up at different distances from starting points along a playing course which resembles a golf course yet can be conveniently set up and varied to create a more challenging course.

SUMMARY OF THE INVENTION

The subject invention is directed to a transportable and inexpensive golf toss game and a method for setting up and playing the golf toss game. The game apparatus of the subject invention includes tossing bags, receptacles which simulate golf holes, identifiers, markers and a scoring sheet. The game is played by tossing the bag at the golf hole receptacles on a playing course planned and set up by the players in a yard, park or any outdoor area to resemble a golf course. The course is conveniently set up at almost any location and may be varied to include obstacles such as trees, shrubs or water to create a more challenging course. The subject invention is specifically designed to provide an inexpensive, easily disassembled and transportable golf toss game which is similar to golf, easy to learn and fun to play. Because there are several targets and the playing course may be varied each time the game is played, the game remains challenging and fun to play even after it has been played many times.

In the preferred embodiment, the golf toss game includes nine receptacles, identifiers and markers for setting up a nine hole playing course. The receptacles are secured to the ground at the finish of each hole and the identifiers are positioned with the receptacles for visually identifying the finish of each hole. The markers are used to indicate a starting point on the playing course for each hole. In addition, the game may include a score sheet for recording the score for each hole for each player.

The receptacles of the preferred embodiment are lightweight plastic cups shaped to be stackable for easily stowing and transporting the cups. Each cup includes a holder for attaching an identifier to the cup. In the preferred embodiment, the holder is connected to the outer wall/inner wall along the side positioned in the center of the cup. The identifiers of the subject invention are flag sticks which are inserted through the holder and pushed into the ground for anchoring the cup to the playing course. The preferred identifier is a stake which is sufficiently sturdy to support the weight of the bag tossed at it and includes a flag at the top displaying the number hole it represents.

In the preferred embodiment, the markers are lightweight stakes and may include a tag at the top which displays the number hole to which the starting point corresponds. The markers are inserted into the ground at a predetermined distance, selected by the players, from the cup to designate the starting point for the hole. The toss bags of the subject invention are small bags made of a tightly woven fabric and filled with sand, plastic beads, beans or the like. The toss bags are preferably different colors for easily distinguishing each player's bag from another player's.

To play the game of the subject invention, the players first plan and set up a playing course in an outdoor area to resemble a golf course. The playing course is set up by positioning and securing the golf hole cups and starting point markers on the playing course. A par for each hole is designated and may be recorded on the score sheet.

While two to six players is recommended, the preferred number of players for the game is four and the game may be played by a single player against par. Each player chooses a colored toss bag to use throughout the entire game. Each player is registered on the score sheet and the game starts with the first player listed. Each player takes turns tossing their bag towards the cup. The player stands upright with his feet planted at the starting point marker and tosses the bag using an underhand toss. The game may be varied in many ways, such as, by having the players toss the bag backward over their shoulder, between their knees or with their eyes closed.

After the players have completed their first toss, each player moves to the location of their tossed bag and stands exactly where their bag landed for the next toss. For the second toss and subsequent tosses, the player who is farthest from the cup leads the next round of tosses. Each player completes the hole by landing their bag in the cup. If a player steps beyond the starting point line while tossing his bag or violates any of the game rules, a point is added to the player's score.

The players' scores are calculated by counting the number of tosses or "strokes" to complete the hole. The scores are recorded on the score sheet as each hole is completed and may be compared to the designated par for the hole. After the ninth hole, the scores for holes are added to determine a total score for each player. As in golf, the player with the least number of "strokes" or lowest score is declared the winner.

Therefore, it is an object and feature of the subject invention to provide a transportable and inexpensive golf toss game resembling golf which is conveniently set up at almost any location, easy to learn and fun to play.

It is another object and feature of the subject invention to provide a golf toss game including tossing bags, receptacles which simulate golf holes, identifiers, markers and a scoring sheet.

It is a further object and feature of the subject invention to provide a method for setting up a playing course resembling a golf course for the golf toss game.

It is yet another object and feature of the subject invention to provide a method for playing the golf toss game resembling golf in which players take turns tossing their bags at the golf hole receptacles set up on the playing course.

Other objects and features will be readily apparent from the accompanying drawings and description.

DETAILED DESCRIPTION OF THE DRAWINGS

Figure 1:
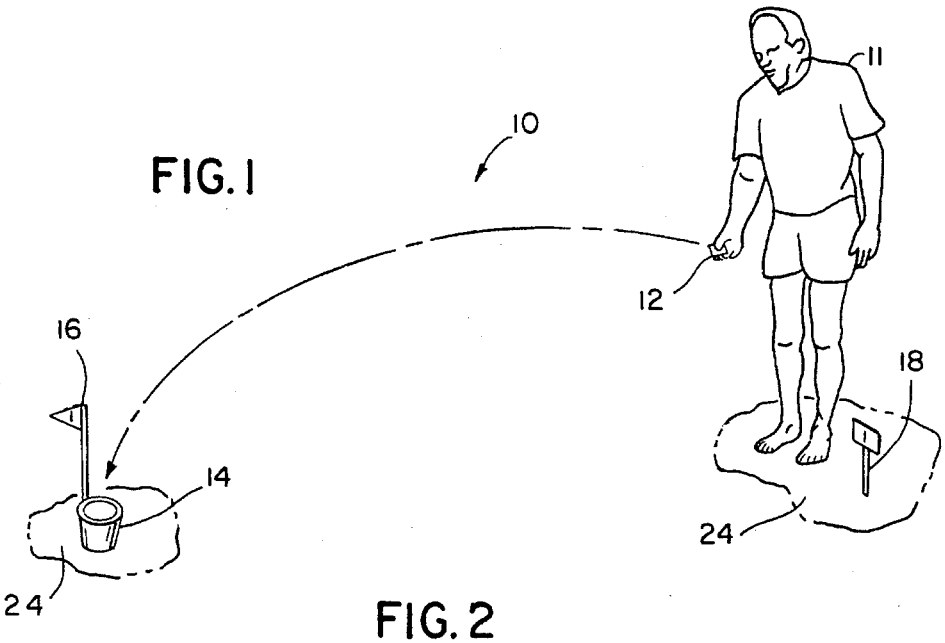
FIG. 1 is a perspective view of the golf toss game of the subject invention as secured to a playing course and illustrating how the game is played by tossing a bag toward a receptacle which simulates a golf hole.
Figure 2:
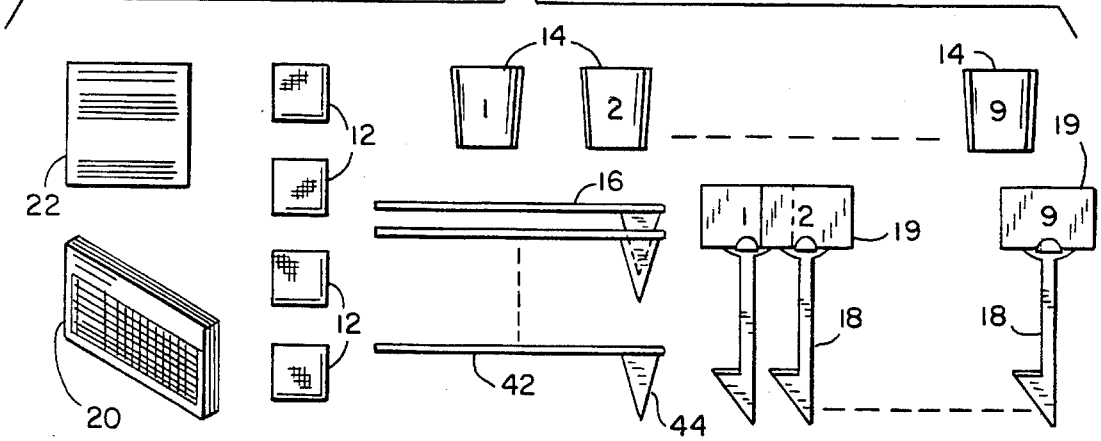
FIG. 2 is a perspective view of the preferred embodiment of the game apparatus including four tossing bags, nine receptacles, nine identifiers for the receptacles, nine starting point markers, a score sheet and an instruction sheet.
Figure 3:
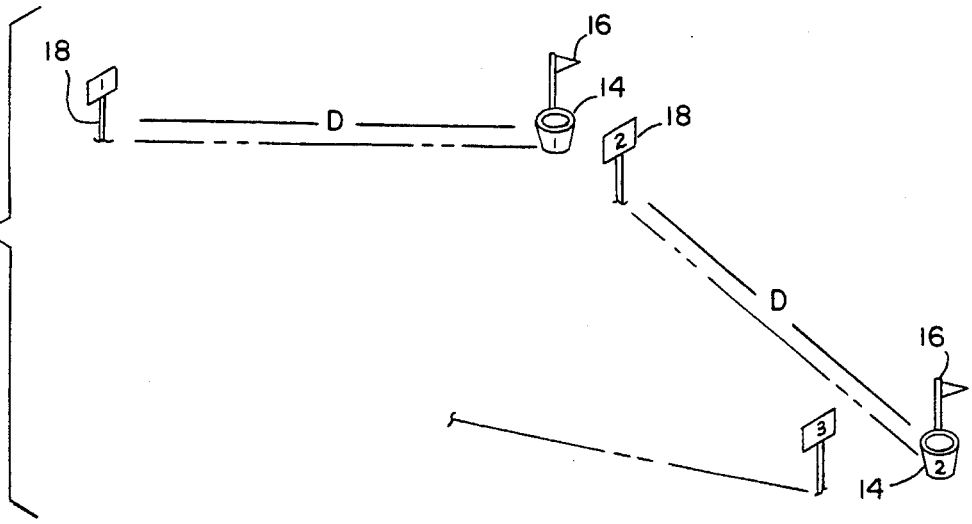
FIG. 3 is a perspective view showing how the game apparatus is set up to play the game with the starting point marker displaying the hole number positioned a certain distance from its respective receptacle and identifier.

Referring to FIGS. 1–3, the transportable and inexpensive golf toss game of the subject invention is generally designated by the numeral 10. The golf toss game includes at least one tossing bag 12 and a plurality of receptacles 14, identifiers 16 and markers 18. The game 10 also includes a scoring sheet 20 and an instruction sheet 22. As shown in FIG. 1, a player 11 plays the game by tossing the bag 12 at the receptacles 14 which simulate golf holes on a playing course 24 planned and set up by the players in a yard, park or any outdoor area to resemble a golf course. The subject invention is specifically designed to provide an inexpensive, easily disassembled and transportable golf toss game which is similar to golf, easy to learn and fun to play.

In the preferred embodiment, the golf toss game includes four tossing bags 12, nine receptacles 14, nine identifiers 16 and nine markers 18 (see FIG. 2) for setting up a nine hole course and playing the game. While the game may be played by a single player or multiple players, the preferred number of players is four. Each receptacle 14 simulates a golf hole on the course and has a corresponding marker 18 to indicate a starting point on the playing course for that hole. The identifiers 16 are positioned with the receptacles 14 for visually identifying the finish of each hole. As illustrated in FIG. 3, each marker 18 is set up a predetermined distance D from its corresponding receptacle 14 and identifier 16 and marks the starting point for that hole. As in golf, the starting point marker 18 for the next sequential hole is set up near the finish of the previous hole so that the players may easily move to the next sequential hole and play the course.

In the golf toss game of the subject invention, each receptacle 14 has an open top 26, interior side walls 28, exterior side walls 30 and a hollow interior 31 for receiving the tossing bag 12. An enlarged cross-sectional view of the preferred and alternative embodiments of the receptacle 14 is illustrated in FIGS. 4–7. In each of the embodiments, the walls 28 and 30 of the receptacle 14 are tapered so that the receptacles are stackable for conveniently stowing and transporting the receptacles. In addition, each receptacle 14 includes a holder 32 for receiving and securing the identifier 16 to the receptacle. The preferred dimensions of the receptacle 14 are approximately four inches in diameter measured across the open top of the receptacle and three and one-half inches in diameter measured across the bottom of the receptacle. The height of the side walls 28 and 30 is approximately four inches.

Figure 4:
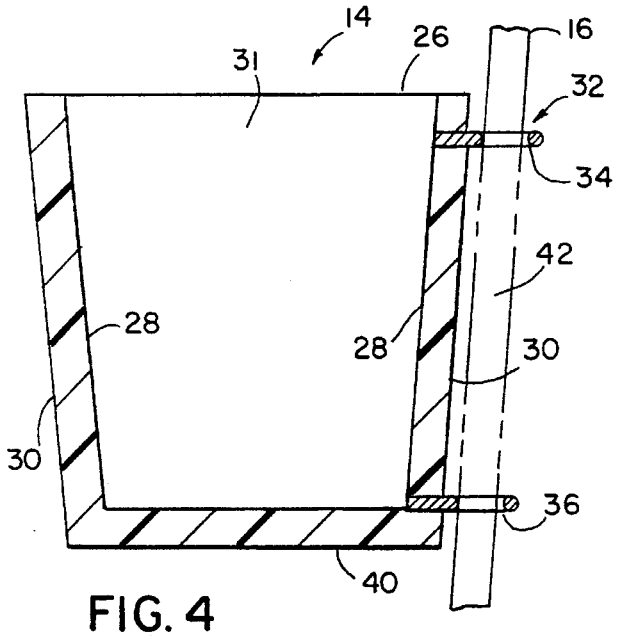
FIG. 4 is an enlarged cross-sectional view of the preferred embodiment of the receptacle showing a cup with a holder comprising two rings attached to the exterior wall of the cup and the identifier inserted through the rings for securing the cup to the playing course.

In the preferred embodiment, the receptacle is a lightweight, plastic cup with the holder 32 attached to the exterior wall of the cup as shown in FIG. 4. The holder 32 includes a first ring 34 positioned near the open top 26 of the cup and a second ring 36 positioned near the bottom. In use, the identifier 16 is inserted through the rings 34 and 36 and pounded into the ground to secure the receptacle 14 to the playing course while also providing a visual aid for locating the receptacle 14. While the preferred receptacle is a lightweight plastic cup, the receptacle 14 may be of any suitable, lightweight material, such as, by way of example, a wire mesh.

Figure 6:
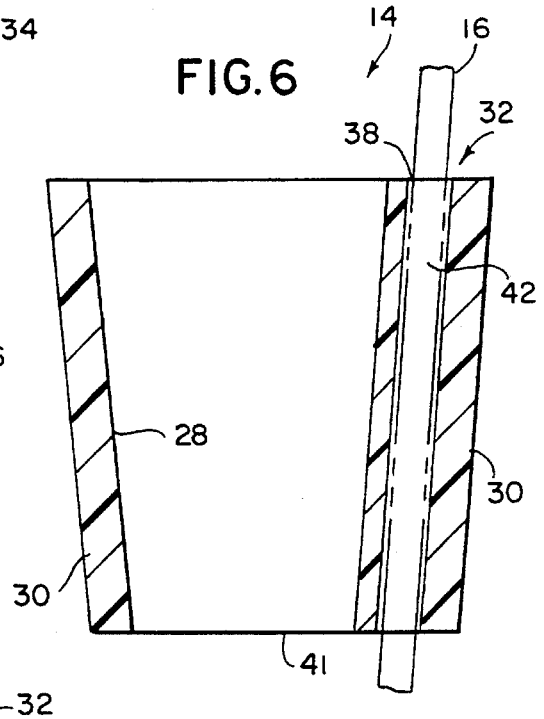
FIG. 6 is an enlarged cross-sectional view of the receptacle similar to FIG. 5 with the holder comprising a tube or channel positioned on the interior wall but where the receptacle has an open bottom.
Figure 5:
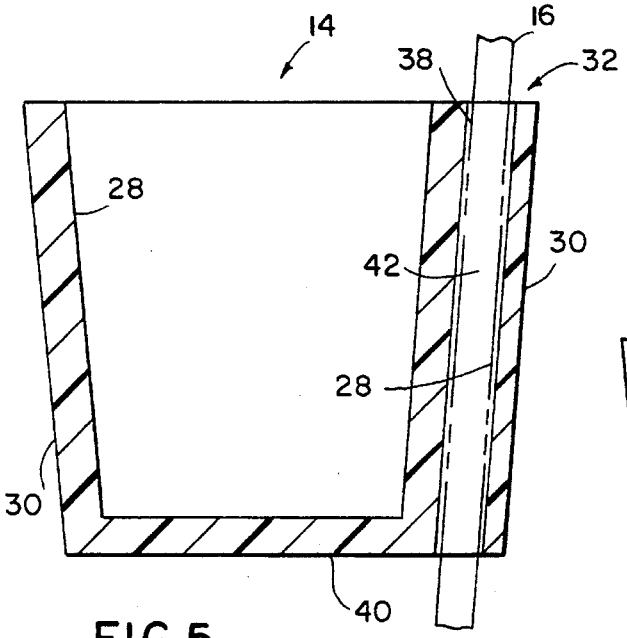
FIG. 5 is an enlarged cross-sectional view of a first alternative embodiment of the receptacle showing a cup with a holder comprising a tube or channel positioned on the interior wall of the cup and the identifier inserted through the tube.

In the first alternative embodiment of the receptacle 14, the holder 32 is positioned adjacent the interior wall 28 (see FIGS. 5 and 6). The holder 32 is a tube or channel 38 adapted to receive the identifier 16 for securing the receptacle to the playing course. The receptacle 14 may include a bottom wall 40 as shown in FIGS. 4, 5 and 7 or may have an open bottom 41, as shown in FIG. 6.

Figure 7:
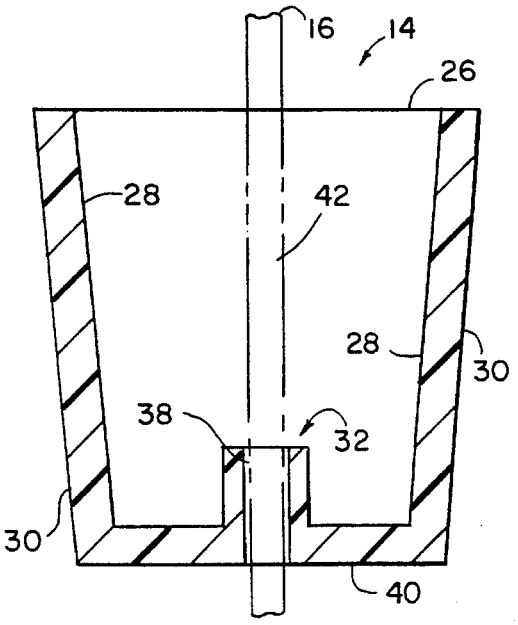
FIG. 7 is an enlarged cross-sectional view of a second alternative embodiment of the receptacle showing a cup with a holder comprising a tube positioned in the center of the receptacle and the identifier inserted through the tube and extending upward through the open top of the receptacle.

A second alternative embodiment of the receptacle 14 is shown in FIG. 7. In this embodiment, the holder 32 is a tube or channel 38 positioned in the center of the bottom wall 40 and adapted to receive the identifier. The identifier 16 is inserted in the channel 38 and extends upward through the open top 26 of the receptacle and through the bottom wall 40 for securing the receptacle to the playing course.

The identifiers 16 of the subject invention are flag sticks positioned with the receptacles for visually identifying the finish of each hole. In the preferred embodiment, the identifiers 16 are relatively thick plastic stakes 42 which inserted through the holders 32 and pounded into the ground for anchoring the receptacles 14 in place along the course. Each stake 42 includes a flag 44 at one end which may display the number hole it represents. Preferably, the stakes 42 are approximately 18 inches in length and sufficiently sturdy to support the weight of the bag 12 tossed at it.

The tossing bags 12 of the subject invention are small bags which can be held in the player's hand and tossed toward the receptacles 14. In the preferred embodiment, the bags 12 are square and approximately three inches by three inches in size. In addition, the bags are made of tightly woven fabric and are filled with sand, plastic beads, beans or the like. If more than one player is playing the game, each player selects a tossing bag 12 to use throughout the game. The tossing bag to be used by each player is preferably a different color, such as, by way of example, the four tossing bags of the preferred embodiment may be red, blue, green and yellow, respectively.

In the preferred embodiment, the markers 18 which designate the starting point for each hole are lightweight plastic stakes including a tag 19 at the top which displays the number hole to which the starting point marker corresponds. The number tag 19 may be round-shaped or may be square, as shown in FIGS. 1–3. In use, the markers 18 are inserted into ground at a predetermined distance D from the corresponding receptacle 14, as selected by the players.

As shown in FIG. 2, the golf toss game 10 also includes a score sheet 20. A par for each hole on the playing course is designated before starting the game by determining the number of desired tosses to complete each hole and may be recorded on the score sheet 20. The name of each player is also recorded on the score sheet 20. The players' scores for each hole are calculated by counting the number of tosses the player made before finishing the hole by landing their bag in the receptacle. The scores are recorded on the score sheet 20 as each hole is completed and may be compared to the designated par for the hole. After the final hole, the scores for each hole are added to determine a total score for each player and declare a winner.

The golf toss game 10 of the subject invention also includes instructions and rules 22 for playing the game. Before playing the game, the players plan and set up a playing course in an outdoor area by positioning and securing the starting point markers 18 and the receptacles 14 with the identifiers 16 on the playing course 24. The playing course 24 may be varied each time the game is played and may include obstacles such as shrubs, trees or water to create a more challenging course.

To play the game, the names of the individuals playing the game are listed on the score sheet 20 and each player chooses a colored tossing bag 12 to use throughout the entire game. The first player listed starts the game by standing upright with his feet planted at the starting point marker 18 for the first hole and tossing his bag 12 toward the receptacle 14. While the game may be varied, in the preferred embodiment, the player uses an underhand toss and may not step beyond the starting point marker 18. If a step is taken, a "penalty stroke" is added to the player's score. The tossed bag 12 lands somewhere between the player and the receptacle 14 and remains where it landed.

Likewise, the second and subsequent players each toss their bag toward the receptacle 14. After all the players have completed their first toss, each player moves to the location of their tossed bag 12 and stands exactly where their bag landed for the next toss. If the player does not stand exactly where their bag landed, they must take a penalty stroke. The player who is farthest from the receptacle 14 leads the next round of tosses followed by the player who is next farthest from the hole and so on. The players continue tossing their bags in this manner until the player completes the hole by landing their bag in the receptacle. As the player nears the receptacle 14, they may not lean over or bend down to get their bag 12 into the receptacle.

The players' scores are calculated by counting the number of tosses or "strokes" to complete the hole plus any points added as "penalty strokes" for violating the rules. After the ninth hole, the scores for holes are added to determine a total score for each player. As in golf, the player with the least number of "strokes" or lowest score is declared the winner. Because the receptacles 14 are set up to resemble golf holes and the playing course 24 may be varied each time the game is played, the game remains challenging and fun to play even after it has been played many times.

While specific embodiments and features of the invention have been disclosed herein, it will be readily understood that the invention encompasses all enhancements and modifications within the scope and spirit of the following claims.

What is claimed is:

1. A transportable golf toss game having a playing course set up in an outdoor area to resemble a golf course, said golf toss game comprising:

a. at least one tossing bag;

b. a plurality of receptacles for receiving the bag, said receptacles arranged on the playing course to simulate golf holes, each said receptacle attached to the ground for securing said receptacle to the playing course, each an receptacle having an open top a hollow interior, interior side walls and exterior side walls and further comprising a holder adapted to receive an identifier wherein the identifier is inserted through the holder and into the ground for securing the receptacle to the playing course;

c. a plurality of identifiers positioned with said receptacles for visually identifying the location of each receptacle on the playing course, said identifiers are connected to said receptacles for providing support and anchoring each said receptacle to the ground;

d. a plurality of markers for defining a starting point for each hole: and e. a score sheet for registering the players and recording the score of each player.

2. The golf toss game of claim 1, wherein the holder is attached to one of the exterior side walls of the receptacle.

3. The golf toss game of claim 1, wherein the holder is attached to one of the interior side walls of the receptacle.

4. The golf toss game of claim 1, wherein the holder is positioned in the center of the interior of the receptacle.

5. The golf toss game of claim 1, wherein the holder is a first and second ring, said rings being attached to the receptacle in a spaced apart position and in vertical alignment with one another.

6. The golf toss game of claim 1, wherein the holder is a channel.

7. The golf toss game of claim 6, wherein each tossing bag is a tightly woven fabric filled with a material.

8. The golf toss game of claim 7, wherein the material is sand.

9. The golf toss game of claim 7, wherein the material is beads.

10. The golf toss game of claim 1, wherein each identifier is a stake having opposite ends, one end including a flag and the other end having a pointed shape for securing the identifier into the ground.

11. The golf toss game of claim 1, wherein the starting point for tossing the bag toward each receptacle is a predetermined distance from the receptacle and wherein said markers are secured to the ground at the various starting points.

12. The golf toss game of claim 11, each marker further comprising a tag displaying a number corresponding to the hole number.

13. The golf toss game of claim 1, further comprising nine receptacles and identifiers arranged on the playing course to simulate golf holes.

14. The golf toss game of claim 13, further comprising nine markers, each marker identifying the starting point for each hole.

15. The golf toss game of claim 1, wherein each tossing bag is a different color.

16. A method of playing a golf toss game having at least two bags, a plurality of receptacles for receiving the bag, the receptacles arranged on the playing course to simulate golf holes, each receptacle attached to the ground for securing the receptacle to the playing course, the receptacle having an open top, a hollow interior, interior side walls and exterior side walls and a holder, a plurality of identifiers positioned with the receptacles for visually identifying the location of each receptacle on the playing course, the identifiers being connected to the receptacles for providing support and anchoring each receptacle to the ground, each identifier is inserted through the holder and into the ground for securing the receptacle to the playing course, a plurality of markers for defining a starting point for each hole, and a score sheet for registering the players and recording the score of each player, comprising the steps of:

a. plotting a playing course in an outdoor area to resemble a golf course;

b. setting up the receptacles along the playing course to simulate golf holes;

c. placing the identifiers with the receptacles for visually identifying the location of each receptacle and securing the receptacle to the course;

d. positioning and securing the markers on the playing course to define a starting point for each golf hole;

e. identifying at least two players to play the game;

f. selecting a tossing bag for each player to throw, each tossing bag distinguishable from each other;

g. standing at the starting point for the hole, each player taking turns tossing their bag toward the hole;

h. moving to the location where their bag landed after the prior toss and standing at that location, each player taking turns tossing their bag toward the hole;

i. completing the hole by landing the bag in the receptacle;

j. determining the score of each player by calculating the number of tosses to complete the hole;

k. continuing to the next hole; and l. adding the score for each hole on the playing course for each player for determining a total score for each player.

17. The method of claim 16, further comprising a step after step (k) of repeating steps (g)–(i) until all holes are played.

18. The method of claim 17, further comprising a step after all holes are played and a total score is determined for each player of determining the lowest total score and declaring a winner.

19. The method of claim 18, wherein determining the score of each player in step (j) further comprises the step of recording the score on the score sheet as each hole is completed.

20. The method of claim 19, wherein determining the total score for each player further comprises recording the total score on the score sheet.

21. The method of claim 17, said game further including a score sheet and wherein identifying the players in step (e) further comprises the step of registering each player on the score sheet.

22. The method of claim 17, further comprising a step following step (d) of designating a maximum number of tosses to complete the hole to define a par for each hole and recording the par on the score sheet.

23. A method of playing a golf toss game having at least one tossing bag, a plurality of receptacles for receiving the bag, the receptacles being arranged on the playing course to simulate golf holes, each receptacle attached to the ground for securing the receptacle to the playing course, the receptacle having an open top a hollow interior, interior side walls and exterior side walls and a holder, a plurality of identifiers positioned with the receptacles for visually identifying the location of each receptacle on the course, the identifiers being connected to the receptacles for providing support and anchoring each receptacle to the ground, each identifier is inserted through the holder and into the ground for securing the receptacle to the playing course, a plurality of markers for defining a starting point for each hole, and a score sheet for registering the players and recording the score of each player, comprising the steps of:

a. plotting a playing course in an outdoor area to resemble a golf course;

b. setting up the receptacles along the playing course to simulate golf holes;

c. placing the identifiers with the receptacles for visually identifying the location of each receptacle of each receptacle and securing the receptacle to the course;

d. positioning and securing the markers on the playing course to define a starting point for each golf hole;

e. identifying at least one player to play the game;

f. selecting a tossing bag for each player to throw, each tossing bag distinguishable from each other;

g. standing at the starting point for the hole, said player tossing their bag toward the hole;

h. moving to the location where their bag landed after the prior toss and standing at that location, said player tossing their bag toward the hole;

i. completing the hole by landing the bag in the receptacle;

j. determining the score by calculating the number of tosses to complete the hole;

k. continuing to the next hole; and l. adding the score for each hole on the playing course for determining a total score.

24. The method of claim 23, further comprising a step after step (k) of repeating steps (g) –(i) until all holes are played.

* * * * *